US008118165B2

(12) United States Patent
Duvekot et al.

(10) Patent No.: US 8,118,165 B2
(45) Date of Patent: Feb. 21, 2012

(54) LATCHING BLANK, SLEEVE AND PACKAGE

(75) Inventors: Loren Duvekot, Goochland, VA (US); Pamela D. Moore, Gloucester, VA (US)

(73) Assignee: Philip Morris USA Inc., Richmond, VA (US)

( * ) Notice: Subject to any disclaimer, the term of this patent is extended or adjusted under 35 U.S.C. 154(b) by 0 days.

(21) Appl. No.: 12/354,473

(22) Filed: Jan. 15, 2009

(65) Prior Publication Data

US 2010/0179041 A1 Jul. 15, 2010

(51) Int. Cl.
*B65D 73/00* (2006.01)

(52) U.S. Cl. ..... 206/474; 206/460; 206/264; 229/82; 229/84

(58) Field of Classification Search ..... 206/242, 206/39.6, 39.7, 472, 473, 474, 731, 732, 206/750, 271, 460, 464, 465, 467, 482, 483, 206/487, 489, 486, 494, 1.5, 800, 525, 525.1, 206/526, 264; 229/931, 930, 131.1, 249, 229/149, 152, 141, 242, 160.2, 193, 174, 229/125.125, 158, 154, 153, 155, 229, 232, 229/237, 925, 103.3, 160, 194, 197, 920, 229/87.01, 125.02, 82, 84, 72; 493/100
See application file for complete search history.

(56) References Cited

U.S. PATENT DOCUMENTS 489,993 A * 1/1893 Spittell ..... 229/197
D35,615 S * 1/1902 Stecher ..... D9/433
835,155 A * 11/1906 Ely ..... 206/750
1,333,102 A * 3/1920 Dietsche ..... 248/351
1,470,141 A * 10/1923 Bryson ..... 229/102
1,615,200 A 1/1927 Shrum
1,760,460 A * 5/1930 Weislow ..... 229/92.5
1,837,602 A 12/1931 Walter
1,898,685 A * 2/1933 Reineman ..... 229/84
2,388,288 A * 11/1945 Ringler et al. ..... 229/198.2
2,511,523 A * 6/1950 Abrams ..... 229/149
2,660,364 A * 11/1953 Ferguson ..... 229/197
2,690,286 A * 9/1954 Dawson ..... 229/103.3
2,801,002 A * 7/1957 Volckening et al. ..... 206/466
4,025,039 A * 5/1977 Croll et al. ..... 206/485
4,063,678 A * 12/1977 Hall ..... 229/102
4,166,534 A 9/1979 Bowden
4,535,929 A * 8/1985 Sherman et al. ..... 229/142
4,727,988 A * 3/1988 Erickson ..... 229/313
5,341,983 A * 8/1994 McGrath ..... 229/198.2
6,044,848 A * 4/2000 Huang ..... 132/321
D519,386 S 4/2006 Aldridge et al.
7,159,717 B2 1/2007 Aldridge et al.
7,325,686 B2 2/2008 Aldridge et al.
2003/0111521 A1* 6/2003 Holmes ..... 229/117
2004/0031706 A1* 2/2004 Stringfield ..... 206/268

(Continued)

OTHER PUBLICATIONS

International Search Report and Written Opinion dated May 10, 2010 for International Application No. PCT/EP2009/009324.

(Continued)

*Primary Examiner* — Mickey Yu
*Assistant Examiner* — Jenine Pagan
(74) *Attorney, Agent, or Firm* — Buchanan Ingersoll & Rooney PC

(57) ABSTRACT

A blank of foldable material to form a sleeve having a recess and a latching mechanism openable and closable by a user. The sleeve can contain articles such as packets of consumer products to form a package.

18 Claims, 11 Drawing Sheets

U.S. PATENT DOCUMENTS

| | | | | |
|---|---|---|---|---|
| 2005/0222849 | A1* | 10/2005 | Rasmussen | 705/1 |
| 2006/0051457 | A1* | 3/2006 | Bougoulas et al. | 426/5 |
| 2008/0202536 | A1 | 8/2008 | Torrence et al. | |
| 2008/0317911 | A1 | 12/2008 | Schleef et al. | |

OTHER PUBLICATIONS

International Preliminary Report on Patentability mailed Jul. 28, 2011 for International Application No. PCT/EP2009/009324.

* cited by examiner

LATCHING BLANK, SLEEVE AND PACKAGE

BACKGROUND

Tobacco products, such as chewing tobacco, snus or moist snuff, are provided in different forms of packaging.

SUMMARY

Provided in an embodiment is a blank of foldable material for forming a sleeve, comprising: pull tab, catch, back cover, front, binding, slot and middle panels for forming respective grip and catch portions of a latch, back cover, front, top, slotted back and dividing walls of the sleeve, wherein the pull tab, the back cover, front, binding, slot and middle panels comprise two substantially parallel sides and two substantially parallel ends which are substantially perpendicular to the sides, the pull tab panel connected to the catch panel by a first fold line, the catch panel comprises ends each having a first part which tapers outward from the first fold line to a locking point and a second part which tapers inward to a corner stop where the catch panel joins the back cover panel, the back cover panel is connected to the front panel by a second fold line, the front panel is connected to the binding panel by a third fold line, the binding panel is connected to the slot panel by a fourth fold line, the slot panel is connected to the middle panel by a fifth fold line, a slot in the slot panel parallel to the sides of the slot panel, the slot comprising a cut-out defined by spaced apart parallel short and long sides wherein the short side is closer to the catch panel, the blank being foldable to form the sleeve defining a recess open at ends thereof with the middle panel dividing the recess, the back cover panel covering a portion of the slot panel and the catch panel can be latched in the slot such that the locking points releaseably engage ends of the slot with the pull tab panel overlying the catch panel and protruding outwardly from the slot.

An embodiment of a method of folding the sleeve from the blank comprises folding back the pull tab panel along the first fold line, folding forward the back cover, front, binding, slot and middle panels of the blank along the second, third, fourth and fifth fold lines, overlying the catch panel with the folded back pull tab panel, inserting the catch panel and a portion of the overlying pull tab panel through the slot such that the locking points releaseably engage ends of the slot to create a latching sleeve.

DETAILED DESCRIPTION

Figure 1A:
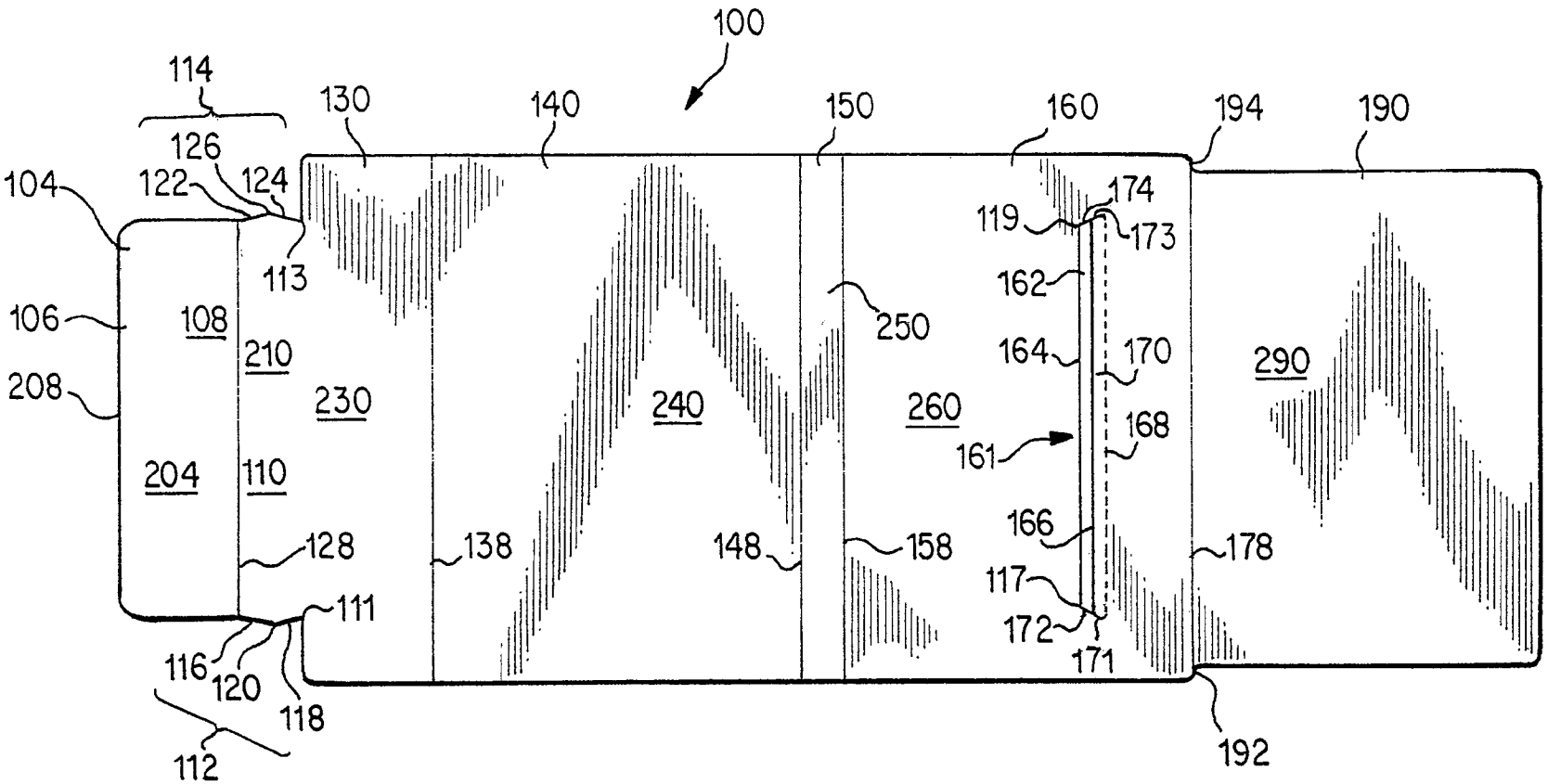
FIG. 1A is an inner plan view of a first embodiment of a blank for forming a first embodiment of a latching sleeve.

The following description of the several embodiments is for illustrative purposes and is not intended to limit the disclosed invention to the described embodiments. In the following descriptions of the several embodiments, references to specific orientations in the drawings, for example, up, down, left, right, front, back, is to facilitate the description and is not intended to limit the embodiments to a particular orientation.

According to an embodiment, a plurality of articles, for example, snus packets, are releaseably attached to inner surfaces of a sleeve open at left and right ends and having a catch panel latched within a slot on a back of the sleeve to form a package. Preferably, a middle panel of the sleeve separates the interior of the sleeve into two recess portions open at left and right ends each containing articles releaseably attached to an inner surface of a respective panel. A pull tab panel connected to the catch panel preferably provides a gripping surface for a user to easily pull the catch panel out of the slot to open the package.

Once opened, the package preferably unfolds to expose articles releaseably attached to inner surfaces of front and back panels. The sleeve opens with the pull tab panel at one side and the middle panel unfolded at the other side, the front and back panels therebetween. In a preferred embodiment, the middle panel can be a tear-off panel and may be a coupon, advertisement, game piece or the like. When the panels are folded, the catch panel can be inserted in the slot in the back panel thus re-closing the package. The ends of the catch panel are preferably caught by ends of the slot to hold the package closed by friction.

Figure 1B:
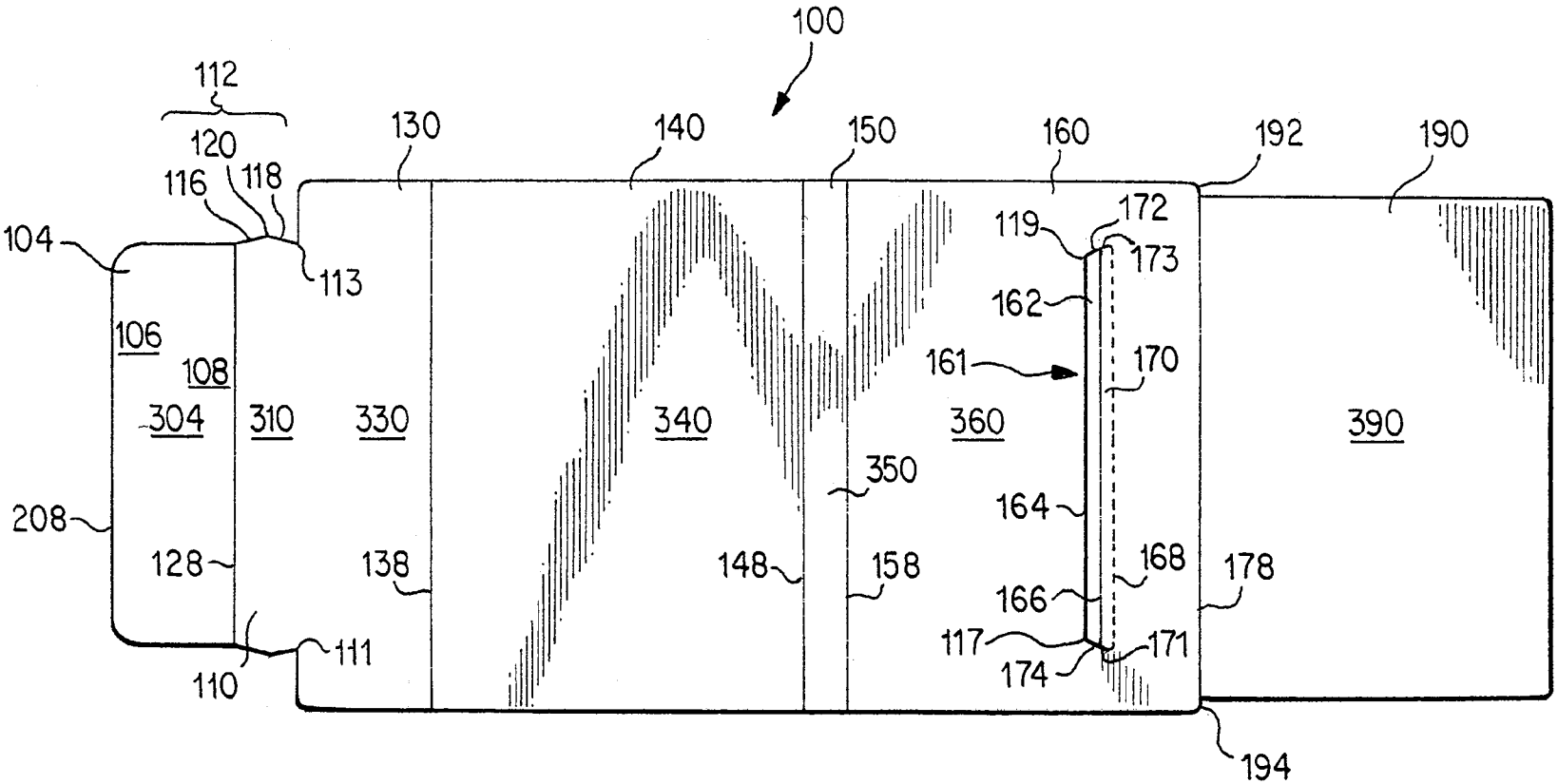
FIG. 1B is an outer plan view of the blank shown in FIG. 1A.

FIG. 1A illustrates an embodiment of a blank 100 for forming an openable and closeable latching sleeve adapted to hold articles such as packets of tobacco pouched products (snus packets). In a preferred embodiment the sleeve holds a plurality of such products each of a different attribute, such as by way of example, flavor. The flavors can be peppermint, spearmint, vanilla, citrus, clove, curry, maple, cherry, and the like. The inner surface of the blank panels are shown in FIG. 1A and the outer surfaces of the blank panels are shown in FIG. 1B. The blank 100 can be composed of any suitable material for example plastic, metal, foil, paperboard, cardboard and any combinations thereof. Preferably, the blank 100 is composed of a paper suitable for forming hinged lid cigarette boxes. The blank 100 can include one or more layers of the paper material. The blank 100 preferably has rounded inside and outside corners to be pleasing to the touch by a user and avoid snagging in a user's pocket.

The blank 100 comprises a plurality of substantially rectilinear panels and a catch panel connected along adjacent sides thereof. The rectilinear panels each have two substantially parallel sides and two substantially parallel ends which are substantially perpendicular to the sides. The catch panel has two substantially parallel sides and two faceted ends, each end having first and second parts which extend outward from the sides to meet at an apex. With reference to FIGS. 1A and 1B the blank 100 comprises a pull tab panel 104 connected along a first fold line 128 to a catch panel 110. The pull tab panel 104 has an inner surface 204, an outside surface 304 and a finger grip portion 106 in a region of a terminal side 208 such that a user can easily operate latching and unlatching the catch panel 110 in the slot 161 as will be described later. A tuck portion 108 of the pull tab panel 104 in a region adjoining the first fold line 128 tucks into the slot 161 when the catch panel 110 is latched in the slot 161 and connects the grip portion 106 to the catch panel 110.

The catch panel 110 has an inner surface 210, an outer surface 310 and two ends 112, 114 and is connected to a back cover panel 230. Each end 112, 114 comprises first and second parts. The first (lower) end 112 has a first part 116 which tapers outward from the first fold line 128 to a locking point 120 and a second part 118 which extends inward to a first corner stop 111 at a first side of the back cover panel 230. The second (upper) end 114 has a first part 122 which tapers outward from the first fold line 128 to a locking point 126 and a second part 124 which extends inward to a second corner stop 113 at the first side of the back cover panel 230. Preferably, the first and second parts 116, 118 of the first end 112 are symmetrical about the locking point 120 and the second end 114 is a mirror image of the first end 112. Although the first and second parts of the first and second ends are shown as straight, the first and second parts of the first and second ends can also be curved.

Preferably, the sides of the back cover panel 130 are longer end to end than the sides of the pull tab panel 104 and the catch panel 110. Preferably, the catch panel 110 is centered on the first side of the back cover panel 130. The back cover panel 130 has an inner surface 230, an outer surface 330 and is connected to the front panel 140 along a second fold line 138 defining a second side of the back cover panel 130.

The front panel 140 has an inner surface 240, an outer surface 340 and is connected to a binding panel 150 along a third fold line 148. The binding panel 150 has an inner surface 250, an outer surface 350 and is connected to a slot panel 160 along a fourth fold line 158.

Figure 6:
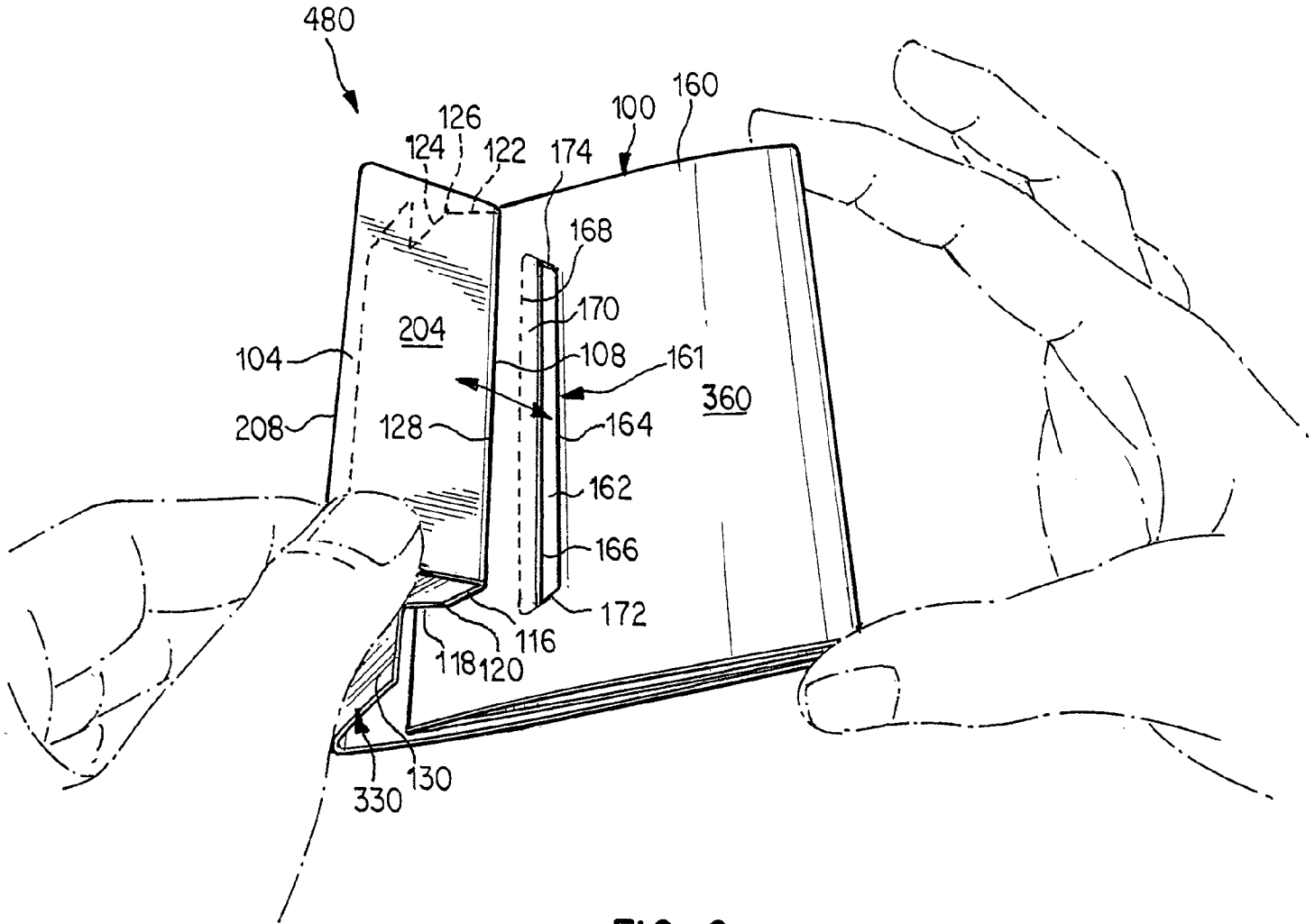
FIG. 6 shows tucking the pull tab panel and a catch panel into a slot in the slot panel of the blank of FIG. 1A to form the latching sleeve.

The slot panel 160 has an inner surface 260, an outer surface 360 and is connected to a middle panel 190 along a fifth fold line 178. The middle panel 190 is at a right side of the blank 100, but is folded into the middle of the sleeve 480 formed of the folded blank 100 (FIG. 6). The middle panel 190 is preferably shorter end-to-end than the slot panel 160 and is centered along the side of the slot panel 160 at the fifth fold line. Preferably, the middle panel 190 is connected to the side of the slot panel 160 at rounded inside corners 192, 194 as shown in FIGS. 1A and 1B.

The slot panel 160 has an elongated slot 161 defined by a slot cut-out 162 and an opening created by a slot flap 170 opening. The slot 161 is of variable size depending on the position of the slot flap 170. The slot cut-out 162 is an opening defined by parallel short and long sides 164, 166 spaced apart by ends 172, 174. Preferably, the slot 161 is centered end-to-end on the slot panel 160 to align with the catch panel 110 and is parallel to the sides. Preferably, the slot 161 is closer to the fifth fold line 178 side-to side. Preferably, the slot 161 is spaced about one-third of the slot panel 160 width from the fifth fold line 178.

Preferably, slits 171, 173 extend from the slot cut-out ends 172, 174 beyond the long side 166 of the slot cut-out 162 to a flap flex line 168 parallel to and spaced apart from the long side 166 by about a distance equal to the width of the slot cut-out 162. The portion of the slot panel 160 within the region defined by the long side 166, slit extensions 171, 173 of the ends 172, 174 and the flap flex line 168 is the slot flap 170 which resists movement and holds the pull tab tuck portion 108 and catch panel 110 in the slot 161. When the slot flap 170 opens from the force of a user pulling the pull tab 104 grip portion 106, the slot 161 opening widens in the direction from the short side 164 to the perforated line 168. Preferably, the slot 161 lengthens in the end-to-end direction from the slot flap 170 opening due to the direction of the slit extensions 171, 173, for example, when the slit extensions 171, 173 are non-parallel and taper outward toward the fifth fold line 178. When the slot flap 170 closes, the slot cut-out 162 remains open.

In a preferred embodiment, the slot cut-out 162, the slot flap 170 and the slot 161 are substantially trapezoidal. Preferably, the slot cut-out ends 172, 174 meet the long side 166 at an angle from about 30 degrees to about 60 degrees, for example, from about 40 to about 50 degrees. Preferably, the slit extensions 171, 173 meet the flap flex line 168 at an angle from about 30 degrees to about 60 degrees, for example, from about 40 to about 50 degrees. Also preferably, the slot cut-out ends are the same length as each other and the slit extensions 171, 173 are the same length as each other. However, it is also preferred that each corner where a slit extension 171, 173 meets the flap flex line 168, is slightly rounded. Such a rounded corner can, for example, prevent tearing of the slot panel 160 at the corners of the slot flap 170. In a preferred embodiment, the flap flex line 168 is a perforated line.

The middle panel 190 has an inner surface 290, an outer surface 390 and is at the opposite side of the blank 100 from the pull tab panel 104.

Figure 2A:
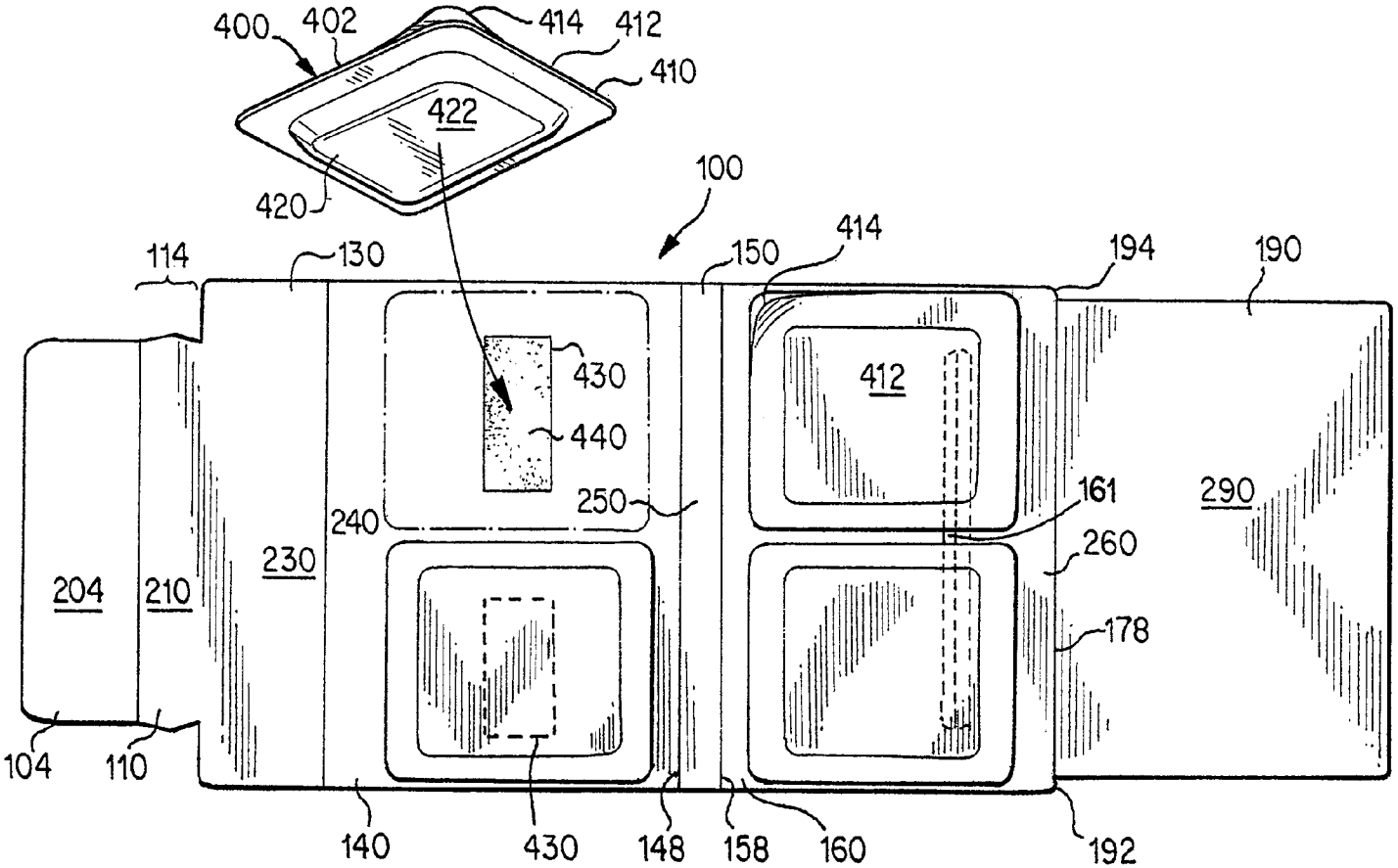
FIGS. 2A and 2B show an embodiment of an article and the article attached to an inner surface of the blank shown in FIG. 1A.

FIG. 2A shows the preferred embodiment of the blank 100 for forming a sleeve having articles 400 attached to the front panel 140 inner surface 240 and the slot panel 160 inner surface 260. Preferably, each article 400 is a packet 402 such as a foil pack, blister pack or the like to contain one or more consumer products in an interior space. In a preferred embodiment, the consumer products include smokeless tobacco products such as pouched smokeless tobacco (snus), other flavor pouches or flavored smokeless tobacco pouches such as described in commonly-owned U.S. Patent Application Publication Nos. 2008/03178911 and 2008/0202536 the entire contents of which are incorporated herein by reference.

Figure 2B:
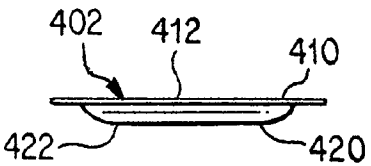

FIG. 2B shows a tray shaped packet 402. The packet 402 includes a removable front cover 410 and a back base 420. Preferably, the base 420 has a flange around a periphery of an opening to an interior space of the packet 402 containing consumer products. Preferably, the front cover 410 is hermetically sealed to the flange and the front cover 410 preferably has a thumb tab 414 for a user to grip the front cover 410 during removal of the cover 410 from the base 420 to access the interior space.

The packet back 422 is preferably removably attached to the inner surface 240 of the front panel 140 and/or the inner surface 260 of the slot panel 160 with an adhesive 440 or the like (for example, glue, quick-release glue, tape, VELCRO, etc.). The adhesive is preferably of limited strength such that the packet 402 can be easily removed from the surface 240, 260 by a user. Preferably, the adhesive 440 is in bonding regions 430 of the inner surfaces 240, 260, which do not interfere with folding of the blank 100 and latching of the catch panel 110 to form the sleeve and package. As shown in FIG. 2A, for example, the backs 422 of two articles 400 are bonded to the inner surface 260 of the slot panel 160 in bonding regions 430 by quick release glue 440 while the backs 422 outside of the bonding regions 430 are not bonded to the inner surface 260. In this way, the articles 400 overlap the slot 161 but the catch panel 110 can still slide through the slot 161 and releaseably latch thereto beneath the backs 422 of the attached articles 400.

Figure 3:
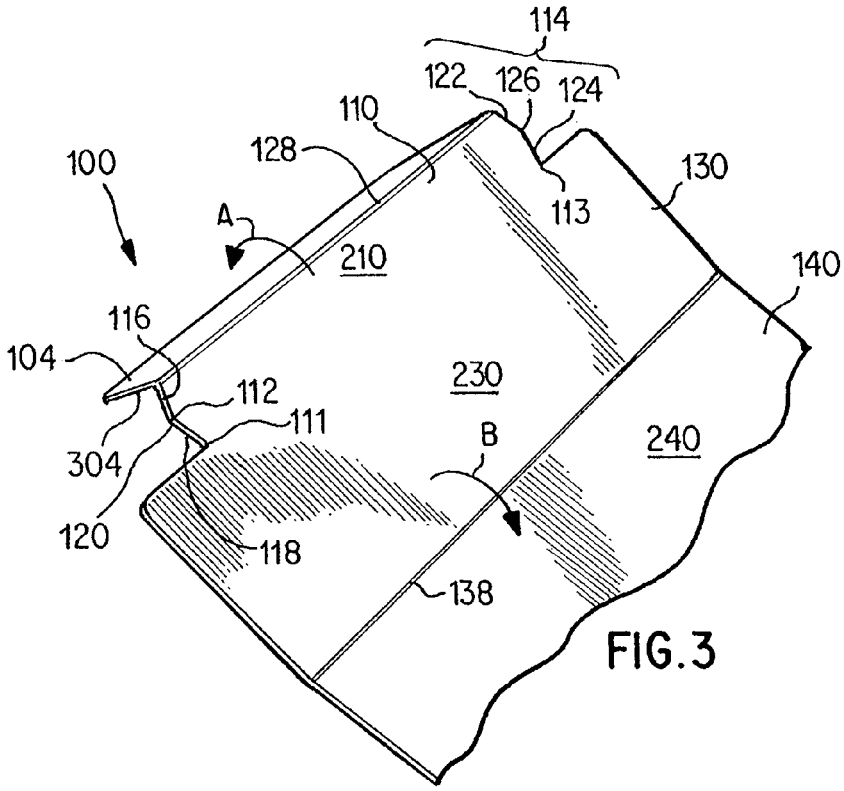
FIG. 3 illustrates folding a pull tab panel and a back cover panel of the blank shown in FIG. 1A.

FIG. 3 illustrates the pull tab panel 104 partially folded back along the first fold line 128 in the direction of arrow "A" and the back cover panel 130 partially folded forward in the direction of arrow "B" along the second fold line 138. The first fold line 128 forms a leading edge to be inserted first into slot 161 (see FIG. 6). The outer surface 304 of the pull tab 104 is brought to face the outer surfaces 310 and 330 of the catch panel 110 and the back cover panel 130. The first 116, 122 and second 118, 124 parts of the first 112 and second 114 ends of the catch panel 110 preferably overhang beyond the ends of the folded back pull tab panel 104 to the locking points 120, 126.

Figure 4:
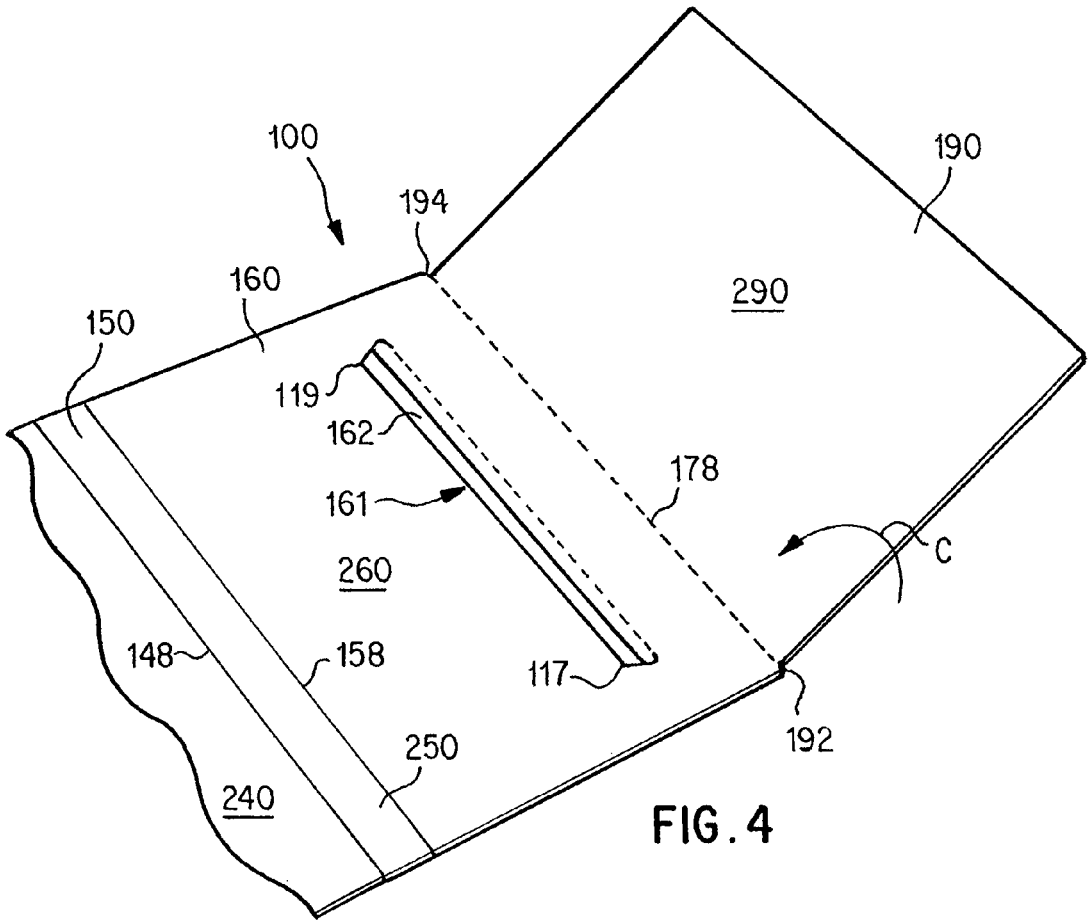
FIG. 4 illustrates folding a middle panel of the blank shown in FIG. 1A.
Figure 5:
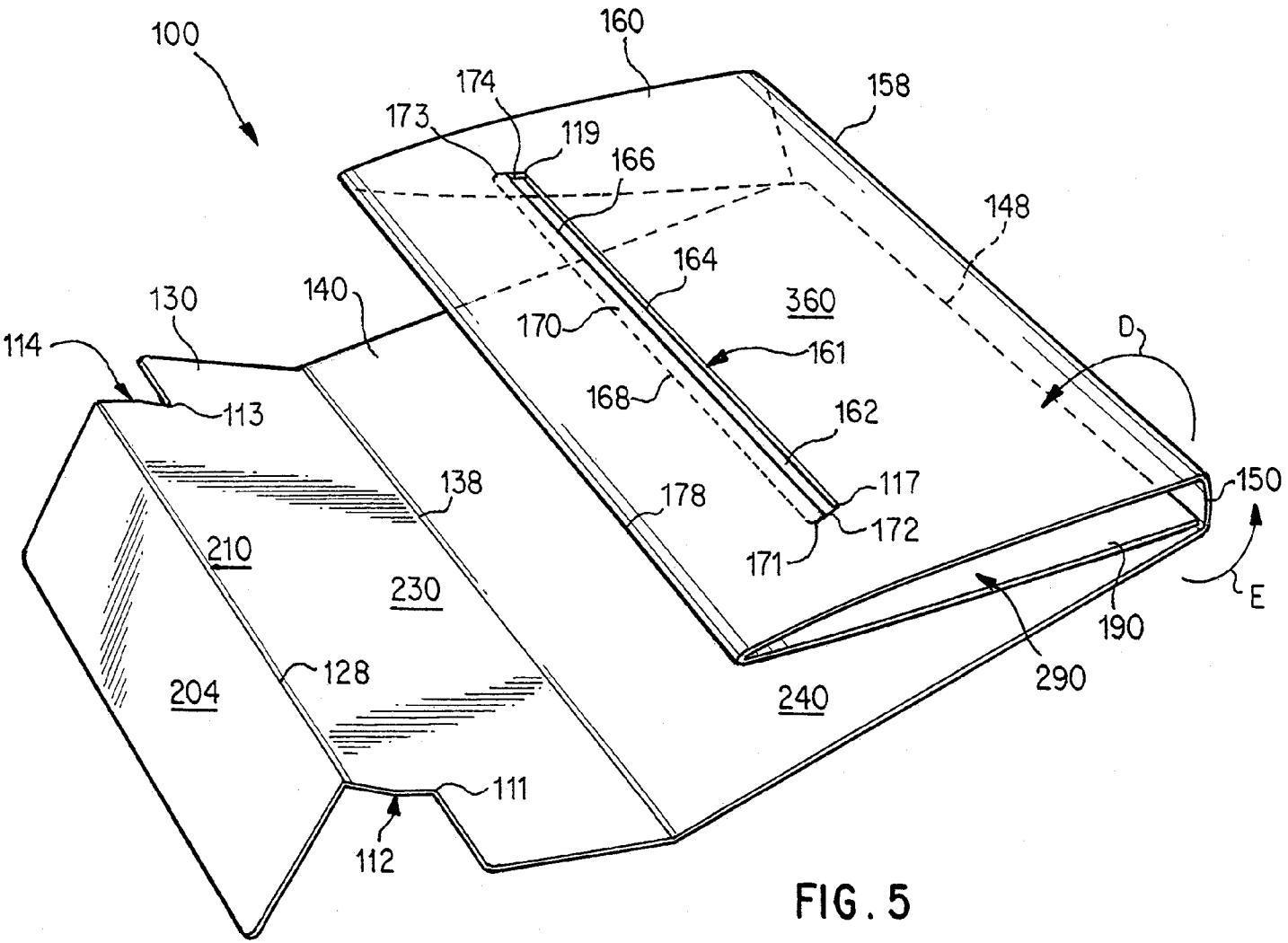
FIG. 5 shows a slot panel of the blank of FIG. 1A folded to form an upper back portion of the latching sleeve.

FIG. 4 illustrates the middle panel 190 partially folded forward along the fifth fold line 178 in a direction "C". The middle panel 190 is folded along the fifth fold line 178 such that the inner surface 290 of the middle panel 190 faces the inner surface 260 of the slot panel 160 (FIG. 5). Preferably, when articles 400 are attached to the slot panel 160 as described above with reference to FIG. 2, the inner surface 290 of the middle panel 190 overlies the fronts 412 of the attached articles 400.

FIG. 5 illustrates the slot panel partially folded forward along the fourth fold line 158 in a direction indicated by arrow "D". The outer surface 390 of the middle panel 190 (FIG. 1B) faces the inner surface 240 of the front panel 140. Preferably, when articles 400 are attached to the front panel 140 as described above with reference to FIG. 2, the outer surface 390 of the middle panel 190 overlies the fronts 412 of the attached articles 400.

The binding panel 150 is preferably folded forward about the third fold line 148 in a direction "E" to space the slot panel 160 apart from the front panel by the width of the binding panel 150 at one side of the front panel 140 adjacent the binding panel 150 as shown in FIG. 5. At the other side of the front panel 140 at the second fold line 138 the front panel 140 comes into close proximity to the slot panel 160 spaced apart therefrom by the middle panel 190 at the fifth fold line 178.

Figure 7:
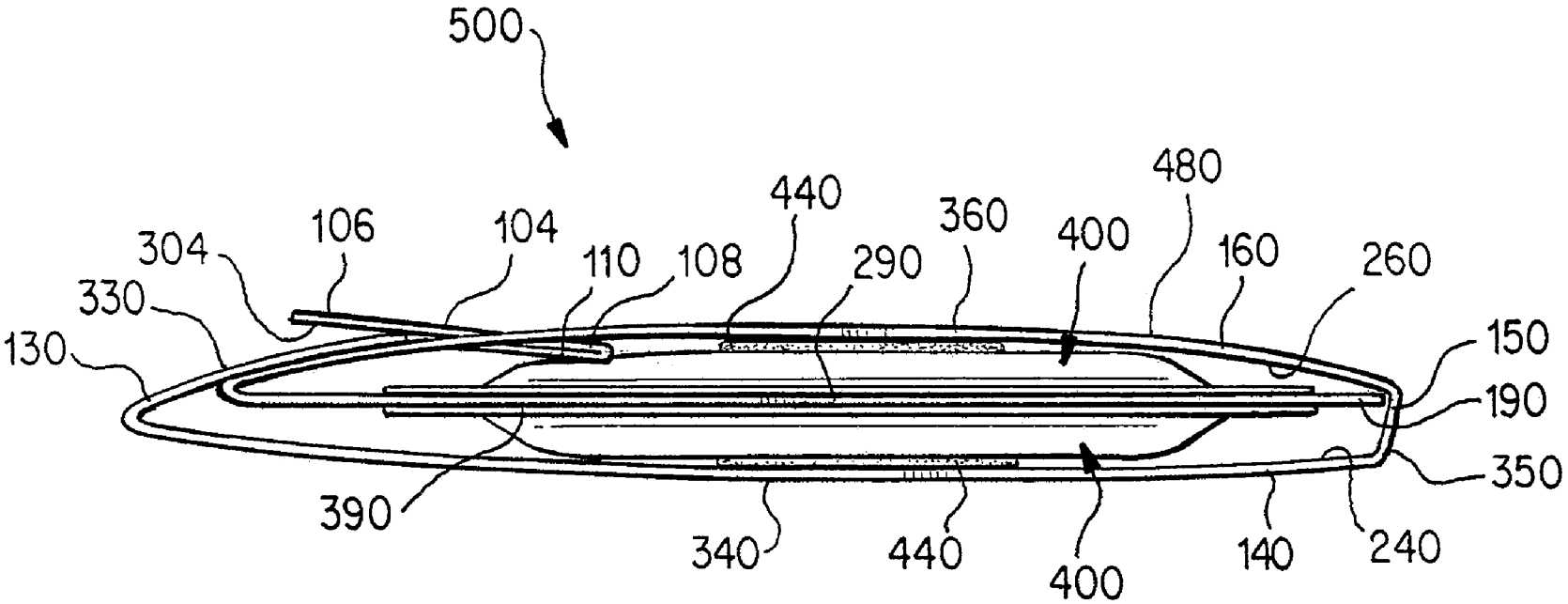
FIG. 7 shows a side view of an embodiment of a package formed of the blank of FIG. 1A folded to form the latching sleeve having articles contained within the sleeve.

When articles 400 are attached to the front panel 140 and/or the slot panel 160, the articles 400 may also space the front panel 140 apart from the slot panel 160 (see, for example, FIG. 7).

FIG. 6 shows the blank 100 folded so the middle panel 190 inner surface 290 faces the slot panel 160 inner surface 260 and the middle panel 190 outer surface 390 faces the front panel 140 inner surface 240. A user can grasp the folded panels 140, 160, 190 for example, in the vicinity of the binding panel 150, with one hand while grasping the pull tab panel 104 with the other hand. The back cover panel 130 folded about the second fold line 138 (in a direction of arrow "B" (FIG. 3)) closes the sleeve 480 to form a package 500 (FIG. 7).

The pull tab panel 104 is folded in a direction of arrow "A" (FIG. 3) along the first fold line 128 so its outer surface 304 (FIG. 1B) faces the outer surface 310 of the catch panel 110 and the outer surface 330 of back cover panel 130. The first fold line 128 forms a leading edge to slideably insert the tuck portion 108 of the pull tab panel 104 and the catch panel 110 into the slot 161 in the slot panel 160. The inner surface 230 of the back cover overlies a lower portion of the outer surface 360 of the slot panel 160 to close the sleeve 480.

More specifically, when the leading edge 128 enters the slot cut-out 162, the first parts 116, 122 of the catch panel 110 ends 112, 114 slideably engage the ends 172, 174 of the slot cut-out 162 while the leading edge 128 wedges the slot flap 170 open. Preferably, the locking points 120, 126 are spaced apart by a distance greater than the long side 166 of the slot cut-out 162, but not too much larger as to inhibit entry and release of the catch panel 110. The first parts 116, 122 slideably engage the slit extensions 171, 173 as the catch panel widens to the locking points 120, 126. After the locking points 120, 126 pass through the slot 161 which is enlarged due to the deflection of the slot flap 170 about the flap flex line 168, the slot flap 170 returns to its starting position and captures the catch panel 110. The catch panel 110 is substantially inserted through the slot 161 and back cover 130 corner stops 111, 113 meet respective distal slot corner stops 117, 119 to prevent the sleeve 480 from closing further. Meanwhile frictional forces of the second parts 118, 124 against the respective slot ends 172, 174 hold the catch panel 110 in the slot 161 latching the sleeve 480 closed. The frictional forces of the slot long side 166 against the catch panel 110 inner surface 210 and the short side 164 against the pull tab 104 inner surface 204 also hold the catch panel 110 in the slot 161.

Although a user's fingers are shown in broken lines in FIG. 6 the blank 100 supporting articles 400 can be folded to form the sleeve 480 and package 500 by automated mechanization at high speed for manufacturing large quantities of the blanks 100, sleeves 480 and/or packages 500 for marketing, distribution or the like.

FIG. 6 illustrates the latching and unlatching of the catch panel 110 in the slot 161 to open and close the package 500. As is evident in FIG. 6, a slight bowing of the catch panel 110 and back cover panel 130 facilitates slipping the leading edge 128 into the slot cut-out 162 such that the straightened catch panel 110 and back cover panel 130 hold the catch panel 110 and tuck portion 108 of the pull tab 104 in the slot 161.

The package 500 of articles 400 in the sleeve 480 formed of the blank 100 (FIG. 1A) is shown in a side elevational view in FIG. 7. The front panel 140 outer surface 340 forms the front of the package 500. An article 400 is attached to the inner surface 240 of the front panel 140 with releasable adhesive 440. The middle panel 190 divides the sleeve 480 recess 460 in two and the middle panel 190 outer surface 390 faces the articles 400 attached to the front panel 140. Articles 400 attached to the inner surface 260 of the slot panel 160 with releasable adhesive 440 are inverted relative to the articles 400 attached to the front panel 140 and spaced apart therefrom by the middle panel 190. The middle panel 190 inner surface 290 faces those articles 400 attached to the slot panel 160. The slot panel 160 outer surface 360 forms a portion of the back of the package 500 from the pull tab panel 104 to the binding panel 150. The back cover 130 outer surface 330 forms the remaining portion of the back of the package 500 with the grip portion 106 of the pull tab panel 104 overlying a portion of the back cover 130 (FIG. 8A) The binding panel 150 outer surface 350 forms a top of the package 500. The catch panel 110 and the tuck portion 108 of the pull tab 104 are on the inside of the sleeve 480 between the slot panel 160 inner surface 260 and an article 400 attached to the slot panel 160 when the sleeve 480 is closed as shown in FIG. 7.

Figure 8A:
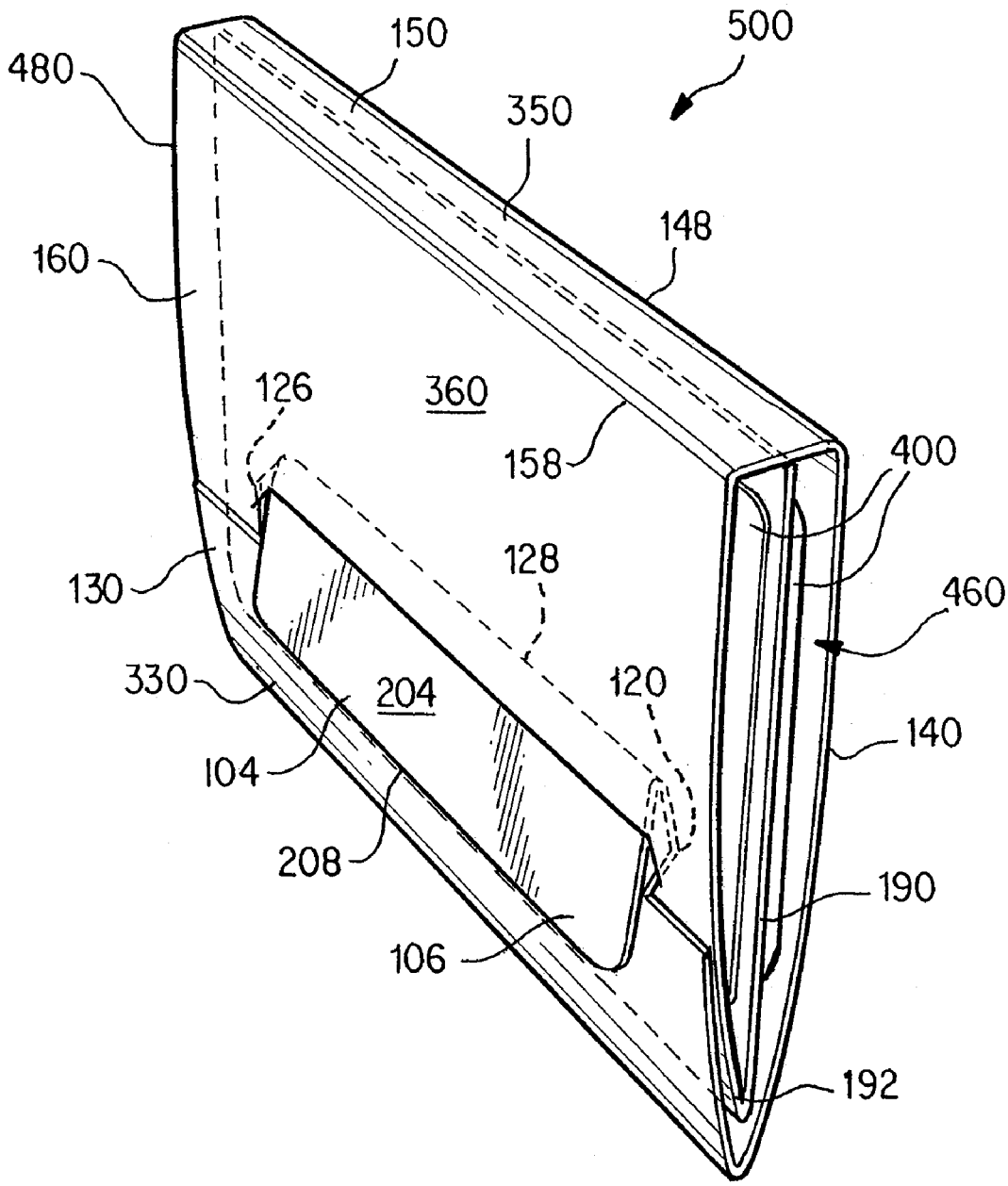
FIG. 8A shows a perspective back view of the embodiment shown in FIG. 7 of the package formed of the blank of FIG. 1A folded to form the latching sleeve having articles contained within the sleeve.

FIG. 8A shows the back of the package 500 formed of the sleeve 480 open at both ends and containing articles 400.

Figure 8B:
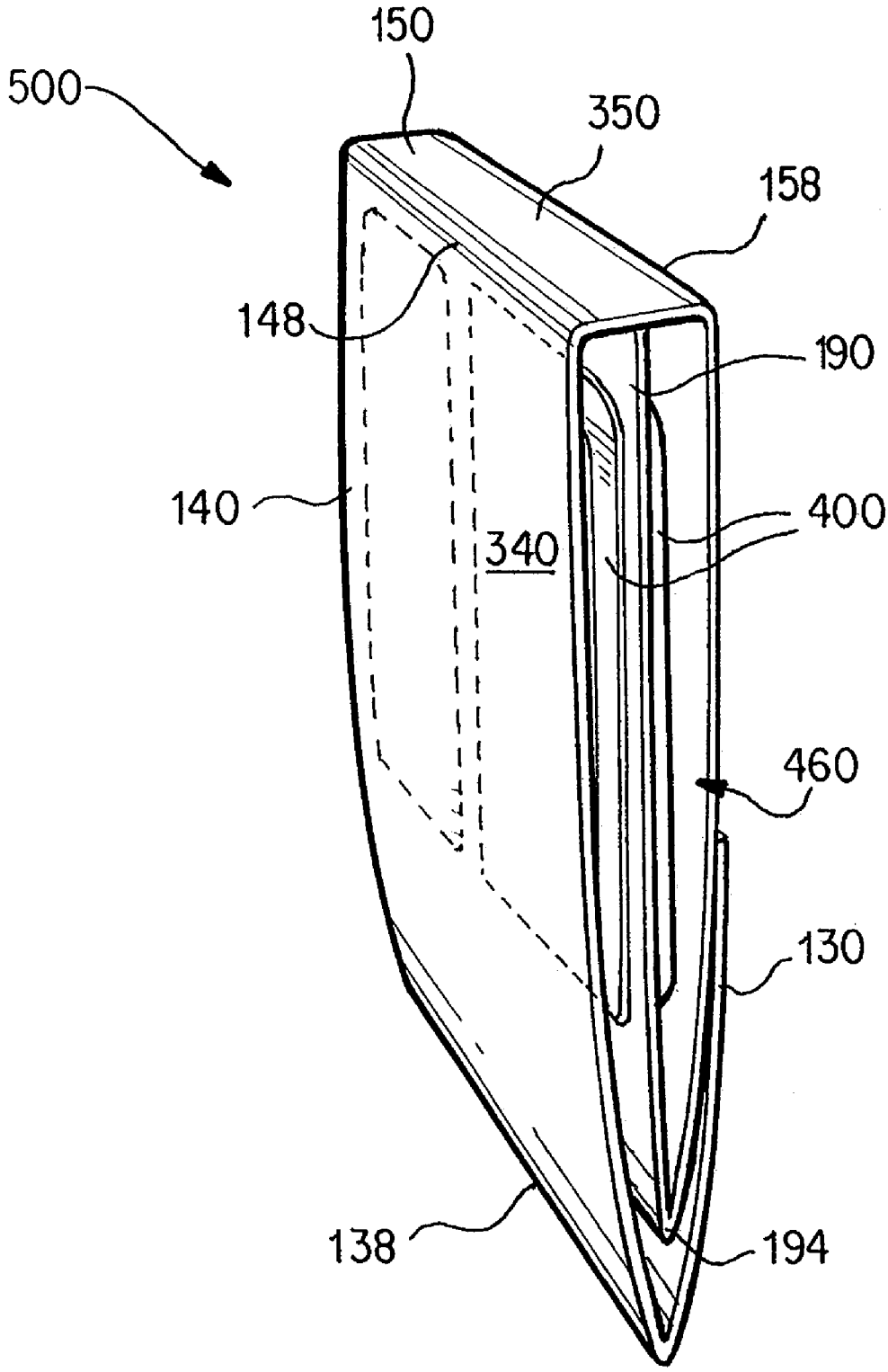
FIG. 8B is a front view of the package shown in FIG. 8A.

FIG. 8B shows a front, top and side perspective view of the package 500 formed of the sleeve 480 open at both ends and containing articles 400. As is evident from FIGS. 8A and 8B, pull tab 104, catch 110, back cover 130, front 140, binding 150, slot 160 and middle 190 panels form respective grip and catch portions of a latch, back cover, front, top, slotted back and dividing walls of the sleeve 500.

A user can tug on the pull tab panel 104 grip portion 106 which protrudes from the slot 161 to overcome the frictional forces to unlatch the catch panel 110 from the slot 161 and open the sleeve 480. Preferably, the user can fold back the back cover panel 130 about the second fold line 138 and fold back the front 140, binding 150, slot 160 and middle 190 panels about the third 148, fourth 158 and fifth 178 fold lines to access articles 400 (FIG. 2) packaged in the sleeve 480.

Figure 9:
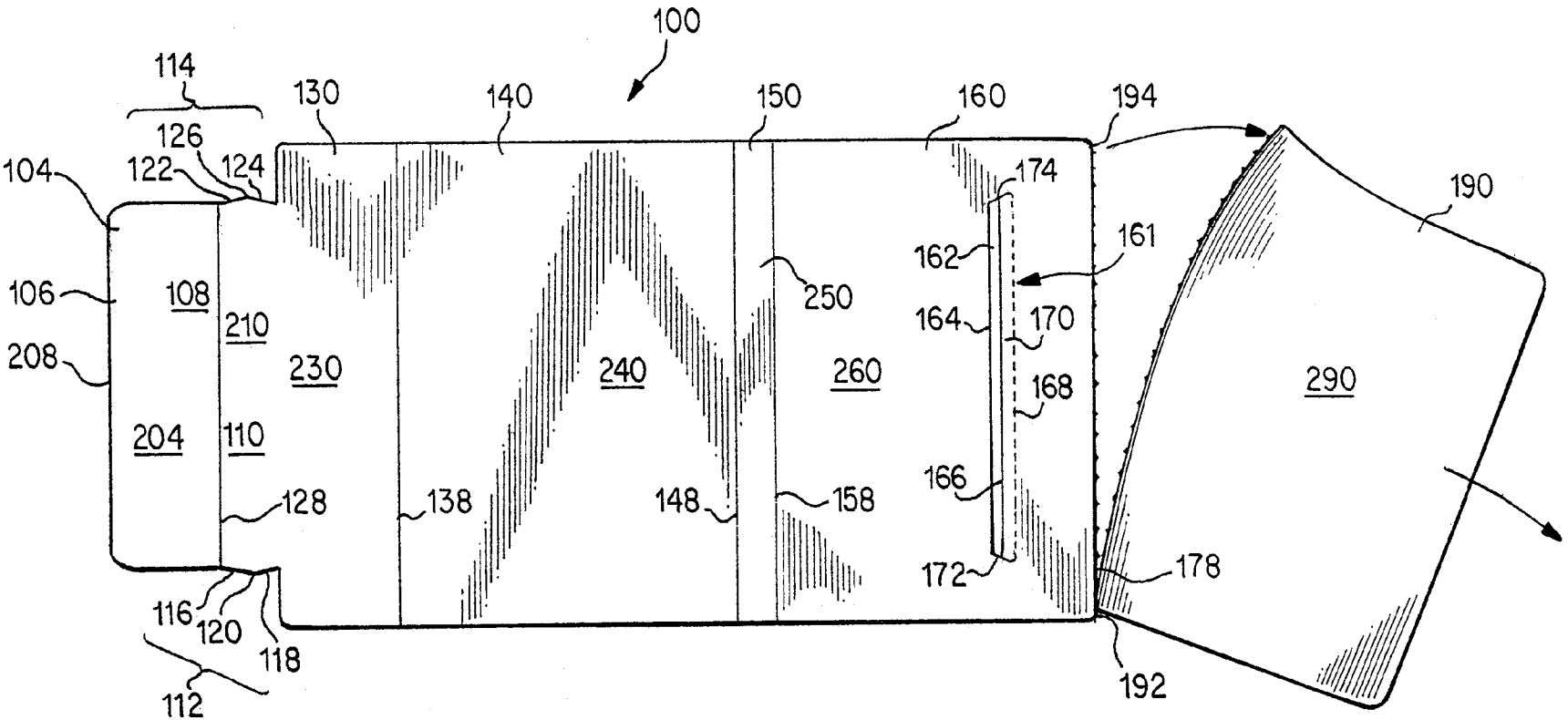
FIG. 9 shows an embodiment of a tear off middle panel of the blank shown in FIG. 1A.

In a preferred embodiment the middle panel 190 can be a tear-off panel and may be a coupon, advertisement, game piece of the like. FIG. 9 shows the fifth fold line 178 can be a perforated easy tear line. In such an embodiment, the user can open the package 500 (FIGS. 8A and 8B) to access articles 400 such as shown in FIG. 2, and remove the middle panel 190. The remaining panels can be re-closed by the user.

As can be seen in FIGS. 6 and 7, the latching mechanism of the package 500 can operate without the middle panel 190. That is, the middle panel 190 does not form an outside wall of the sleeve 480 and is not a part of the latch. The latch, as described above, includes inserting the catch panel 110 and tuck portion 108 of the tab panel 104 into the slot 161 of the slot panel 160.

Figure 10:
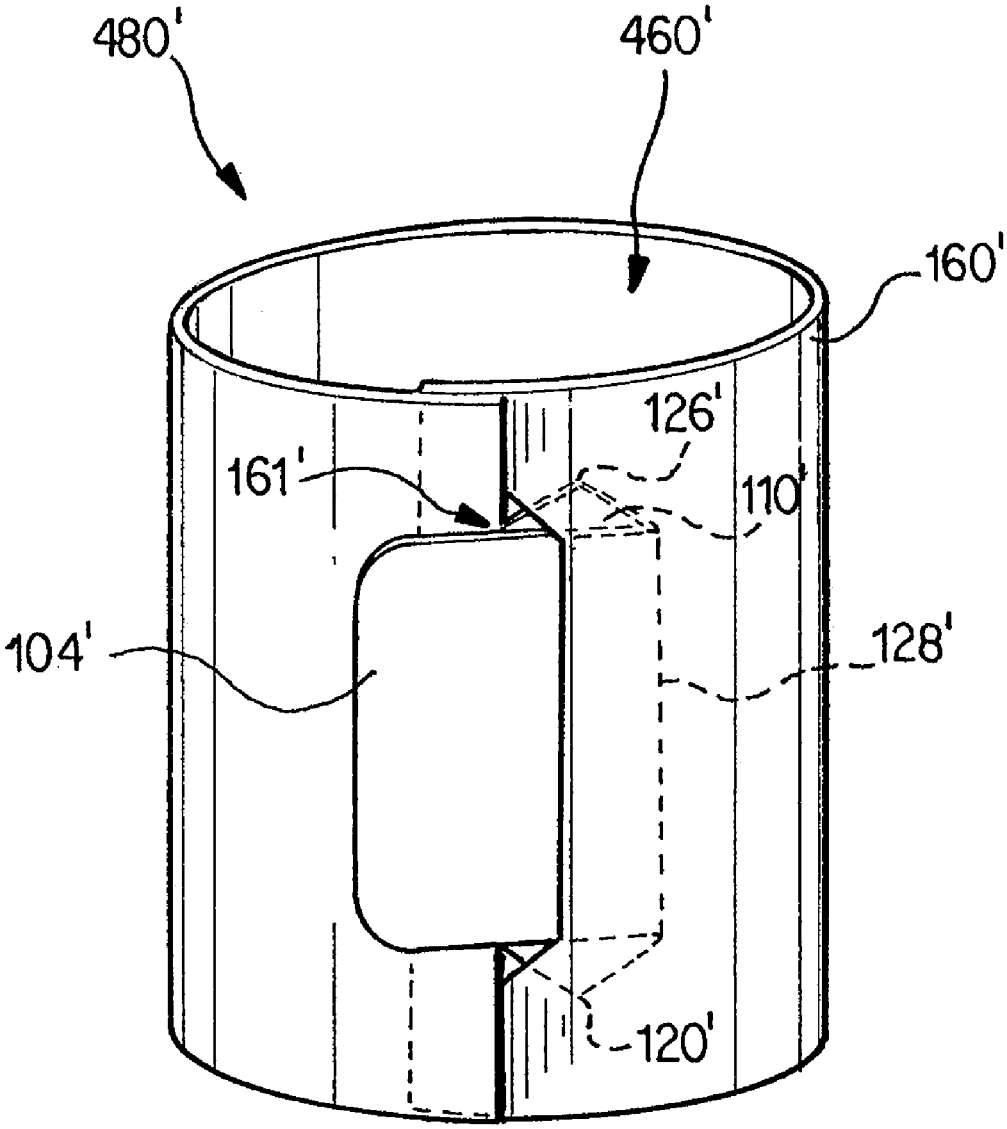
FIG. 10 shows a perspective view of another embodiment of a latching sleeve formed of another embodiment of a blank.

The latch design can be adapted to different packaging concepts. Referring now to FIG. 10, for example, in an embodiment, a blank can comprise a slot panel 160' having a slot 161' as described above to accept a catch panel 110' with locking points 120', 126' to releaseably engage ends of the slot 161'. The catch panel 110' can be connected at one side to a pull tab 104' at a fold line 128'. At the other side of the catch panel, second parts of first and second ends can attach directly to the slot panel 160'. The catch panel 110' can be latched in the slot 161' of the slot panel 160' having the pull tab 104' protruding outwardly from the slot 161' to form a cylindrical (for example, elliptical cylinder) sleeve 480' having the slot panel 160' form the wall of the sleeve 480' surrounding a recess 460' open at the top and bottom. The latch can be adapted to other packaging concepts such as cubic openable boxes, rectangular cuboids, trianguloids (triangular prism, triangular pyramid, etc.) and various others.

While the invention has been described in detail with reference to specific embodiments thereof, it will be apparent to those skilled in the art that various changes and modifications can be made, and equivalents employed, without departing from the scope of the appended claims.

The invention claimed is:

1. A blank of foldable material to form a sleeve, comprising:

pull tab, catch and slot panels for forming respective grip and catch portions of a latch and a wall of the sleeve, wherein the pull tab and the slot panels comprise two substantially parallel sides and two substantially parallel ends which are substantially perpendicular to the sides, the pull tab panel connected to the catch panel by a fold line, the catch panel comprises ends each having a first part which tapers outward from the first fold line to a locking point and a second part which tapers inward to a corner stop, and wherein the first part and the second part of each of the ends of the catch panel are symmetrical, a slot in the slot panel parallel to the sides of the slot panel, the slot comprising a cut-out defined by spaced apart parallel short and long sides wherein the short side is closer to the catch panel and wherein the slot has a substantially trapezoidal shape with non-parallel diverging ends being equal in length and is expandable by a slot flap formed by slit extensions in the slot panel, the slit extensions extending in line with the diverging ends beyond the long side of the cut-out to a flap flex line parallel to the sides of the cut-out; and back cover, front, binding, and middle panels for forming respective, back cover, front, top, and dividing walls of the sleeve, wherein the back cover, front, binding and middle panels comprise two substantially parallel sides and two substantially parallel ends which are substantially perpendicular to the sides, wherein the corner stop is located where the catch panel joins the back cover panel, the back cover panel is connected to the front panel by a second fold line, the front panel is connected to the binding panel by a third fold line, the binding panel is connected to the slot panel by a fourth fold line, the slot panel is connected to the middle panel by a fifth fold line;

the blank being foldable to form the sleeve with the middle panel dividing the recess and the back cover panel covering a portion of the slot panel, and;

the blank being foldable to form the sleeve defining a recess open at ends thereof and the catch panel can be latched in the slot such that the locking points releaseably engage ends of the slot with the pull tab panel overlying the catch panel and protruding outwardly from the slot.

2. The blank of claim 1, wherein articles of consumer products are attached to inner surfaces of the slot panel, the front panel, or a combination thereof to form a package.

3. The blank of claim 2, wherein the articles of consumer products are blister packs, or foil packs of snus.

4. The blank of claim 3, wherein the articles of consumer products include a plurality of packs each having one of various flavors.

5. The blank of claim 1, wherein the fifth fold line is an easy tear perforation so that the middle panel is detachable and the middle panel optionally bears indicia for a coupon, advertisement, or game piece.

6. The blank of claim 1, wherein the flap flex line is a perforated line and each slit meets the perforated line at rounded corners.

7. The blank of claim 1, wherein the diverging ends meet the long side at an angle from about 30 degrees to about 60 degrees.

8. The blank of claim 1, wherein the slit extensions are equal in length and meet the flap flex line at an angle from about 30 degrees to about 60 degrees.

9. A sleeve formed from a folded blank according to claim 1, wherein:

the front panel forms a front face of the sleeve and an inner front face of the recess;

the binding panel forms a top outer face of the sleeve and an inner top face of the recess;

the slot panel forms a portion of a back outer face of the sleeve and an inner back face of the recess;

the middle panel forms an inner back face of a front portion of the recess and an inner front face of a back portion of the recess; and the back cover overlies a portion of the slot panel forming the remaining portion of the outer back face of the sleeve to close the recess having the catch panel latched in the slot such that the locking points releaseably engage the ends of the slot.

10. The sleeve of claim 9, wherein the pull tab presses against the short side of the slot and the catch panel presses against the long side of the slot.

11. A package comprising a sleeve according to claim 9, having at least one article releaseably attached to the inner front face and/or the inner back face of the recess.

12. The package of claim 11, wherein the at least one article comprises four articles on the inner front face and/or the inner back face of the recess.

13. The package of claim 11, wherein the at least one article comprises a foil pack which has a removable cover enclosing a base, which contains smokeless tobacco products.

14. A method of forming a sleeve from the blank according to claim 1, comprising:

folding back the pull tab panel of the blank along the first fold line, folding forward the back cover, front, binding, slot and middle panels along the second, third, fourth, and fifth fold lines to create the recess between the front and slot panels divided by the middle panel open at the left and right;

overlying a portion of the catch panel and a portion of the back cover panel with the pull tab panel, overlying a portion of the slot panel with the back cover panel, inserting the catch panel, the first fold line and a portion of the pull tab panel into the slot to releaseably latch the catch panel in the slot such that the locking points engage the ends of the slot to create a latching sleeve.

15. The method of claim 14, further comprising releaseably bonding at least one article to the front panel and/or the slot panel in the recess forming a package.

16. The blank of claim 1, wherein the first part and the second part of each of the ends of the catch panel are straight.

17. The blank of claim 1, wherein the first part and the second part of each of the ends of the catch panel are curved.

18. A blank of foldable material to form a sleeve, comprising:

pull tab, catch and slot panels for forming respective grip and catch portions of a latch and a wall of the sleeve, wherein the pull tab and the slot panels comprise two substantially parallel sides and two substantially parallel ends which are substantially perpendicular to the sides, the pull tab panel connected to the catch panel by a fold line, the catch panel comprises ends each having a first part which tapers outward from the first fold line to a locking point and a second part which tapers inward to a corner stop, and wherein the first part and the second part of each of the ends of the catch panel are symmetrical, a slot in the slot panel parallel to the sides of the slot panel, the slot comprising a cut-out defined by spaced apart parallel short and long sides wherein the short side is closer to the catch panel and wherein the slot has a substantially trapezoidal shape with non-parallel diverging ends being equal in length and is expandable by a slot flap formed by slit extensions in the slot panel, the slit extensions extending in line with the diverging ends beyond the long side of the cut-out to a flap flex line parallel to the sides of the cut-out;

back cover, front, binding, and middle panels for forming respective, back cover, front, top, and dividing walls of the sleeve, wherein the back cover, front, binding and middle panels comprise two substantially parallel sides and two substantially parallel ends which are substantially perpendicular to the sides, wherein the corner stop is located where the catch panel joins the back cover panel, the back cover panel is connected to the front panel by a second fold line, the front panel is connected to the binding panel by a third fold line, the binding panel is connected to the slot panel by a fourth fold line, the slot panel is connected to the middle panel by a fifth fold line;

the blank being foldable to form the sleeve and defining a recess open at ends thereof and the catch panel can be latched in the slot such that the locking points releaseably engage ends of the slot with the pull tab panel overlying the catch panel and protruding outwardly from the slot with the middle panel dividing the recess and the back cover panel covering a portion of the slot panel, wherein articles of consumer products are attached to inner surfaces of the slot panel, the front panel, or a combination thereof to form a package, wherein the articles of consumer products are blister packs, or foil packs of snus having various flavors.

* * * * *